US010323416B2

(12) United States Patent
Horton

(10) Patent No.: US 10,323,416 B2
(45) Date of Patent: Jun. 18, 2019

(54) ROOFING SYSTEMS FOR STEEP PITCH METAL ROOFING

(71) Applicant: Southeastern Metals Manufacturing Company, Inc., Jacksonville, FL (US)

(72) Inventor: James W. Horton, Jacksonville, FL (US)

(73) Assignee: Sotheaster Metals Manufacturing Company, Inc.

( * ) Notice: Subject to any disclaimer, the term of this patent is extended or adjusted under 35 U.S.C. 154(b) by 5 days.

(21) Appl. No.: 15/861,382

(22) Filed: Jan. 3, 2018

(65) Prior Publication Data

US 2018/0135303 A1 May 17, 2018

Related U.S. Application Data

(63) Continuation-in-part of application No. 14/724,950, filed on May 29, 2015, now Pat. No. 9,896,846.

(60) Provisional application No. 62/119,287, filed on Feb. 23, 2015, provisional application No. 62/093,338, filed on Dec. 17, 2014.

(51) Int. Cl.

| | |
|---|---|
| ***E04D 5/14*** | (2006.01) |
| ***E04D 1/18*** | (2006.01) |
| ***E04D 1/34*** | (2006.01) |
| ***E04D 3/16*** | (2006.01) |
| ***E04D 12/00*** | (2006.01) |

(52) U.S. Cl.

CPC ..... *E04D 5/144* (2013.01); *E04D 1/18* (2013.01); *E04D 1/34* (2013.01); *E04D 3/16* (2013.01); *E04D 5/141* (2013.01); *E04D 5/149* (2013.01); *E04D 12/002* (2013.01); *E04D 2001/3435* (2013.01)

(58) Field of Classification Search

USPC ..... 52/58–62, 105, 408, 409, 506.05

See application file for complete search history.

(56) References Cited

U.S. PATENT DOCUMENTS

| | | | | | |
|---|---|---|---|---|---|
| 4,382,353 | A * | 5/1983 | Kelly | E04D 1/365 | 52/309.5 |
| 4,570,396 | A * | 2/1986 | Struben | E04B 7/00 | 52/199 |
| 4,712,348 | A * | 12/1987 | Triplett | E04D 5/143 | 52/408 |
| 4,864,781 | A * | 9/1989 | Emblin | E04D 3/38 | 52/58 |
| 6,250,036 | B1 * | 6/2001 | Nurley | E04D 3/3606 | 52/408 |

(Continued)

*Primary Examiner* — Brian E Glessner
*Assistant Examiner* — Adam G Barlow
(74) *Attorney, Agent, or Firm* — Jennifer Meredith, Esq.; Lippes Mathias Wexler Friedman LLP

(57) ABSTRACT

A roofing system having at least one underlayment layer; at least two nail fasteners attached to the at least one underlayment layer and into the roof deck, wherein the head of each of the nail fasteners is above the at underlayment layer and the shaft is driven through the underlayment layer and into the roof deck; at least one bead of adhesive applied above the underlayment layer; and at least one metal roofing panels placed on the at least one bead of adhesive applied above the underlayment layer, wherein the at least one metal roofing panels are above the at least two nail fasteners and the at least two nail fasteners do not penetrate the at least one metal roofing panels.

17 Claims, 5 Drawing Sheets

(56) References Cited

U.S. PATENT DOCUMENTS

| | | | | |
|---|---|---|---|---|
| 6,279,293 | B1 * | 8/2001 | Ojala | E04B 1/26 52/302.3 |
| 7,987,647 | B2 * | 8/2011 | Rymell | E04D 3/3608 52/408 |
| 2002/0189189 | A1 * | 12/2002 | Kupczyk | E04D 1/26 52/557 |
| 2010/0300011 | A1 * | 12/2010 | Crego | E04D 3/365 52/60 |
| 2012/0233949 | A1 * | 9/2012 | Brannon | E04D 3/3602 52/410 |
| 2014/0115980 | A1 * | 5/2014 | Edwards | E04D 13/152 52/173.3 |

* cited by examiner

ROOFING SYSTEMS FOR STEEP PITCH METAL ROOFING

The present invention relates to metal roofing systems having a steep pitch slope.

Low Slope Roofing is less than 2:12 to flat built up roofing. The present invention is directed to the particular problems posed by Steep Pitch Metal Roofs which are greater than 2:12. The pitch of a roof is its vertical rise divided by its horizontal span (or "run"), what is called "slope" in geometry and stair construction. In the USA, the run is denominated by the number 12, giving a ratio of how many inches of rise or fall there are to each 12 inches (one foot) of run. For example, 3:12, 4:12, 5:12, and so on.

The present invention is utilized in lieu of the screw attached 3"-6" metal plates which are the current industry attachment method. One problem with this method of attaching metal roofing plates is that each screw through the metal creates a source for future leaks and buckling.

The systems and methods of the present invention provide a metal roofing panel fastener system comprised of an underlayment layer with nail fasteners through the underlayment layer and into the roof deck. There may be a bead of adhesive on top of the underlayment layer (and the nail fasteners) and the metal roofing panels are placed in the adhesive. In this way, the nail fasteners never penetrate the metal roofing panel. The nail fasteners may also be placed in a specific nail pattern arrangement which provides increased strength and prevents adhesive uplift.

The innovative system according to the present invention provides a cleaner look, installs faster than traditional metal roofs, cuts down on production time because the adhesive eliminates the need for pre-drilling screw holes in the metal panels. Also, because the adhesive stays flexible this allows for natural expansion and contraction of the metal roofing panels. This has the additional benefit of minimizing the dimpling effects of oil canning.

BRIEF SUMMARY OF THE INVENTION

The present invention provides a roofing system, comprising at least one underlayment layer; at least two nail fasteners attached to the at least one underlayment layer and into the roof deck, wherein the head of each of the nail fasteners is above the at underlayment layer and the shaft is driven through the underlayment layer and into the roof deck; at least one bead of adhesive applied above the underlayment layer; and at least one metal roofing panel placed on the at least one bead of adhesive applied above the underlayment layer, wherein the at least one metal roofing panel are above the at least two nail fasteners and the at least two nail fasteners do not penetrate the metal roofing panels.

The nail fasteners may be according to a nail pattern that is sets of three rows that are perpendicular to a side of the roofing surface and applied a predetermined distance, for example six inches, on center through the underlayment layer. The nail fasteners may be ring shank roofing nails.

DETAILED DESCRIPTION OF THE INVENTION

Figure 1:
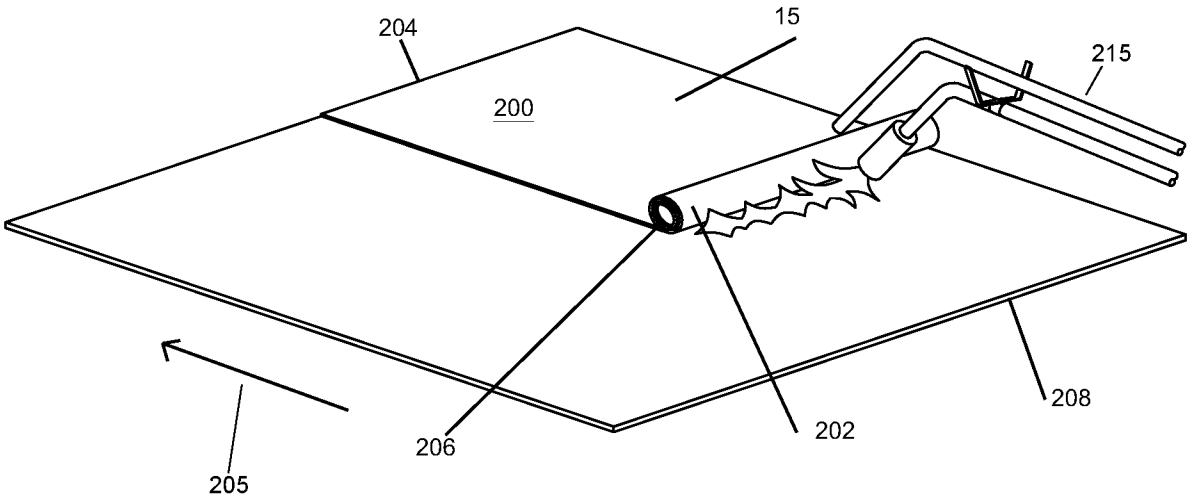
FIG. 1 depicts the underlayment layer being applied.
Figure 2:
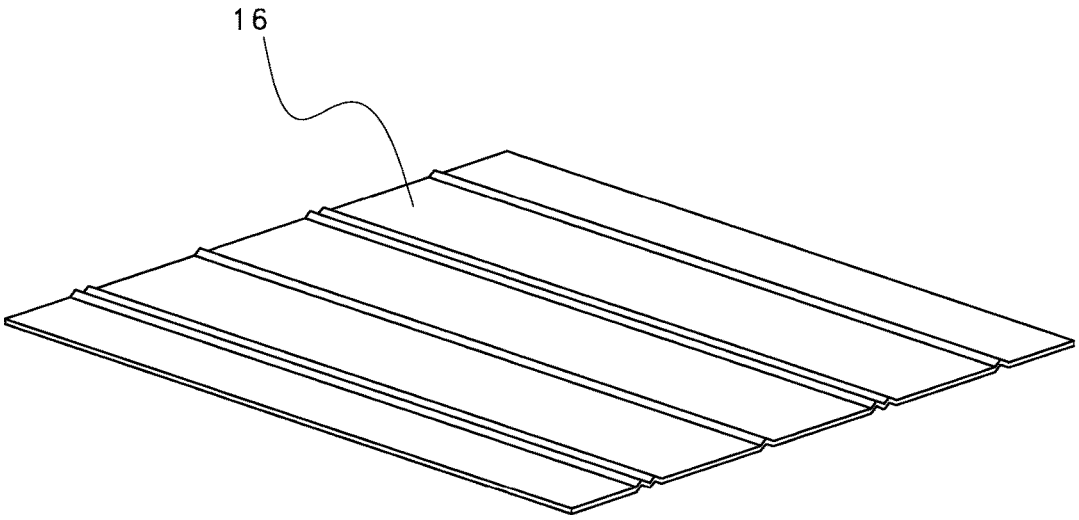
FIG. 2 depicts a metal roofing panel.
Figure 3:
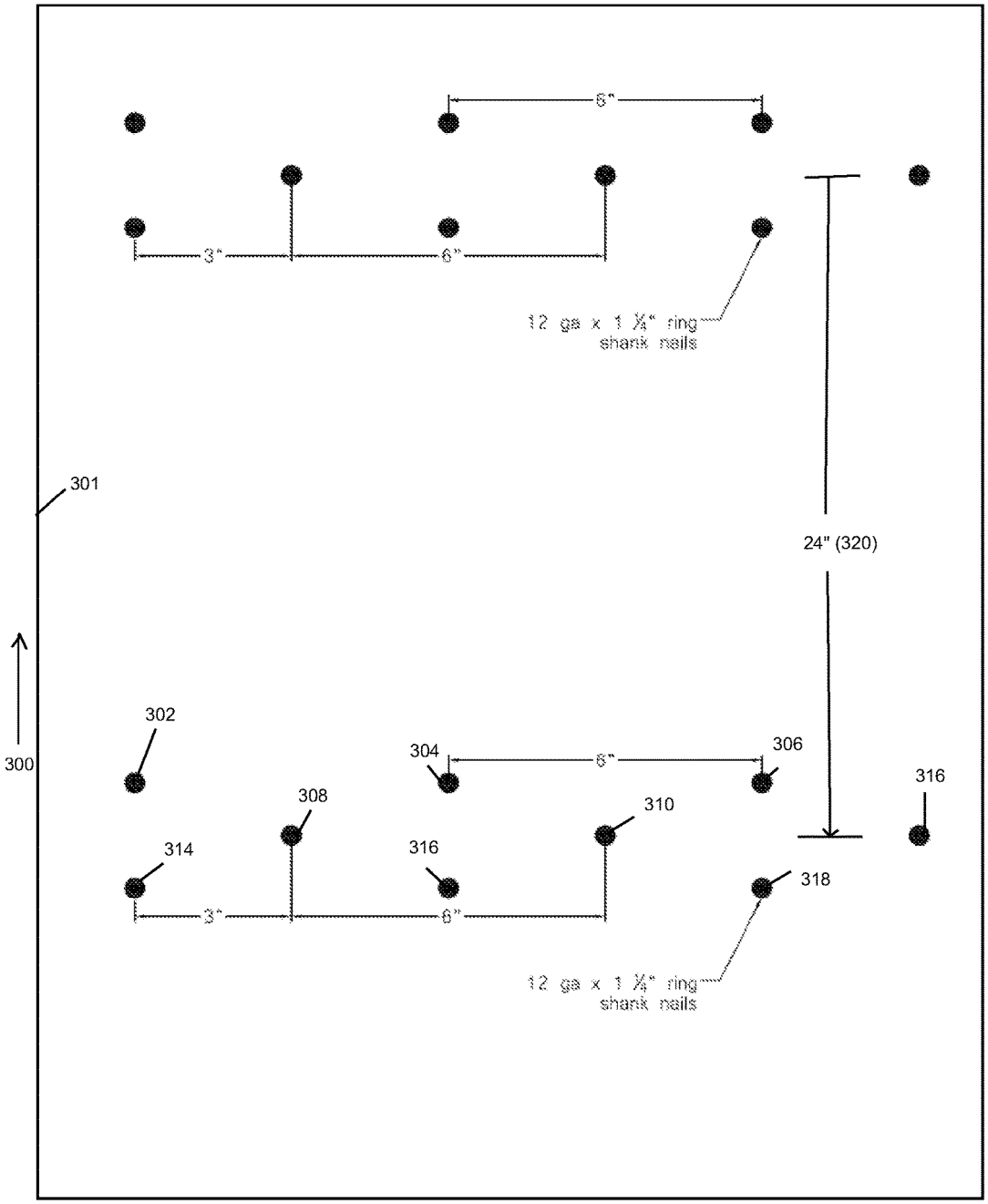
FIG. 3 a nail pattern through the self-sealing underlayment layer.

The present invention provides a roofing system, comprising: at least one underlayment layer, which may be a roll (15) having a top (200), a bottom (202), first end (204) and a second end and being impermeable to moisture. The underlayment layer may be breathable, but does not allow moisture to permeate. The second end (206) of the roll is at the end of the roll. The first end (204) of the underlayment roll (15) is fastened over a center of a top rib in a roof deck and the underlayment roll is dispensed in a first row and cut at the end of the roof deck (208) creating a cut end (210) and fastened at the cut end. The cut end (210) may be additionally fastened by nail fasteners, for example roofing gun nails (in addition to the adhesive). The head of each of the nail fasteners is above the at underlayment layer and the shaft of the nail fastener is driven through the underlayment layer and into the roof deck. The nail fasteners may be ring shank roofing nails. The nail fasteners may be in withdrawal and also in shear. The underlayment layer may be an adhesive underlayment layer and may be heat assisted. As shown in FIG. 2, a blow torch may create heat to further bond the adhesive layer. This is typically used for two part adhesives. The first end of the underlayment roll is fastened over a center of a top rib in a roof deck primarily in adhesive tension for withdrawal and also in shear. The underlayment layer may be a self-sealing underlayment layer. Examples of the self-sealing underlayment layer may be those made by GCP Applied Technologies, Polyglass, CertainTeed, SOPREMA, and Mid-States, NFM Building Products, Ultra HT Wind & Water and Tile & Metal. By way of example, SOPREMA makes an underlayment layer LASTOBOND Shield HT (high temperature) is a SBS-modified bitumen underlayment for use in approved steep slope assemblies, and is designed to withstand service temperatures up to 240° F. (116° C.). LASTOBOND Shield HT is composed of a proprietary formulation of elastomeric styrene-butadiene-styrene (SBS) polymer modified bitumen in combination with high tack self-adhesive. The topside is surfaced with a high strength tri-laminate polyethylene film and the underside is surfaced with protective polyolefin release film that is removed during application. SOPREMA also makes LASTOBOND® ECO is an SBS-modified bitumen underlayment for use in approved composition shingle steep slope assemblies. LASTOBOND ECO is composed of a proprietary formulation of elastomeric styrene-butadiene-styrene (SBS) polymer modified bitumen in combination with high tack self-adhesive and is reinforced with a high quality random glass fiber mat. The topside is surfaced with mineral aggregate and the underside is surfaced with protective polyolefin release film that is removed during application. SOPREMA also makes LASTOBOND® Shield is a self-adhered reinforced underlayment composed of special elastomeric modified bitumen blends of SBS. LASTOBOND Shield is designed to be used under shingles and composition shingle roof systems. LASTOBOND Shield has a split-back release film allowing for self adhered application. These are examples of underlayment layers that may be utilized according to the present invention. The at least one underlayment layer may be an underlayment roll rolled onto a center tube for attachment to a dispensing handle (215). The underlayment layer may also have on center fastener location markings according to a nail pattern. FIG. 3 depicts an example of a nail pattern that may be marked on the underlayment layer.

The bottom (202) typically has an adhesive layer applied to it. A second row (1500) of the underlayment roll is positioned overlapping the first row (1502) and dispensed in a second row (1602) and cut at the end of the roof deck (1504) creating another cut end (1604) and fastened at the cut end. The underlayment roll may have on center fastener location markings (1506) of a predetermined length (1504). The underlayment roll is positioned overlapping a row that was previously laid down to create as many rows as are needed to entirely cover the roof deck. The at least one underlayment roll may be rolled onto a center tube for attachment to a dispensing handle. The arrows (e.g. 205 and 300) in each of the figures show the slope up the roof. By way of description, the ˆ end of the arrow would be at a higher elevation than the line end.

Figure 4:
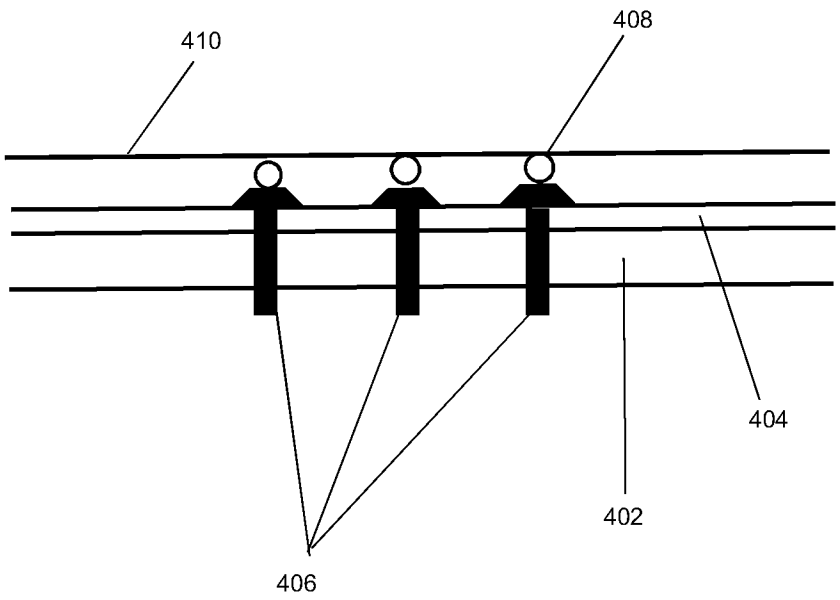
FIG. 4 depicts a side view of the arrangement according to the present invention.

There may be at least one bead of adhesive applied above the underlayment layer which may be in line with the at least two nail fasteners. This is to say it may be in a line along a row of at least two nail fasteners. The at least two metal roofing panels placed on the at least one bead of adhesive applied above the underlayment layer, wherein the at least two metal roofing panels are above the at least two nail fasteners and the at least two nail fasteners do not penetrate the at least two metal roofing panels. FIG. 4 depicts one example of a side view according to the present invention. A roofing system (400) is depicted with at least one underlayment layer (404); at least two nail fasteners (406) attached to the at least one underlayment layer (404) and into the roof deck (402). The head of each of the nail fasteners (406) is above the at underlayment layer (404) and the shaft is driven through the underlayment layer and into the roof deck (402). At least one bead of adhesive (408) may be applied above the underlayment layer in line with the at least two nail fasteners; and at least one metal roofing panels (410) may be placed on the at least one bead of adhesive applied above the underlayment layer, wherein the at least one metal roofing panels is above the at least two nail fasteners and the at least two nail fasteners do not penetrate the at least one metal roofing panels. The preferred adhesive is a two part epoxy including non-slump, and low slump (not rise). The adhesive may, less preferably, be a foam adhesive, a urethane adhesive and sealant, one part polyurethane tube adhesive and sealant, two-part polyurethane tube adhesives including no rise, medium and high rise foam versions, Butyl adhesive and sealant tube, Butyl adhesive and sealant tape, Two-part epoxies including no rise, low rise and medium rise foam adhesives, liquid nails, modified-bituminous adhesive tape and tar, TPO Adhesives, TPO self-adhering products, and non-bituminous peel and stick adhesives.

As shown in FIG. 3, the at least two nail fasteners may be according to a nail pattern that is sets of three rows that are perpendicular to a side (301) of the roofing surface and applied a predetermined distance on center through the underlayment layer. A first row is created by nail fasteners (314, 316 and 318) that are each placed six inches apart. A second row is created by nail fasteners (308, 310 and 312) that are also placed a predetermined distance (which is six inches) apart, the first nail fastener (308) is placed halfway between the first nail fastener (314) and the second nail fastener (310) of the first row to create a staggered nail pattern. As can be seen, the first nail fastener (308) is spaced three inches from first nail fastener (314) and three inches from the second nail fastener (316). This creates an offset row. The nail pattern may be repeated a predetermined length on center, for example a predetermined length of 24 inches on center. This to say that there may be a 24 inch vertical space (320) between the middle row of the three rows and a middle row of the next set of three rows.

Figure 5:
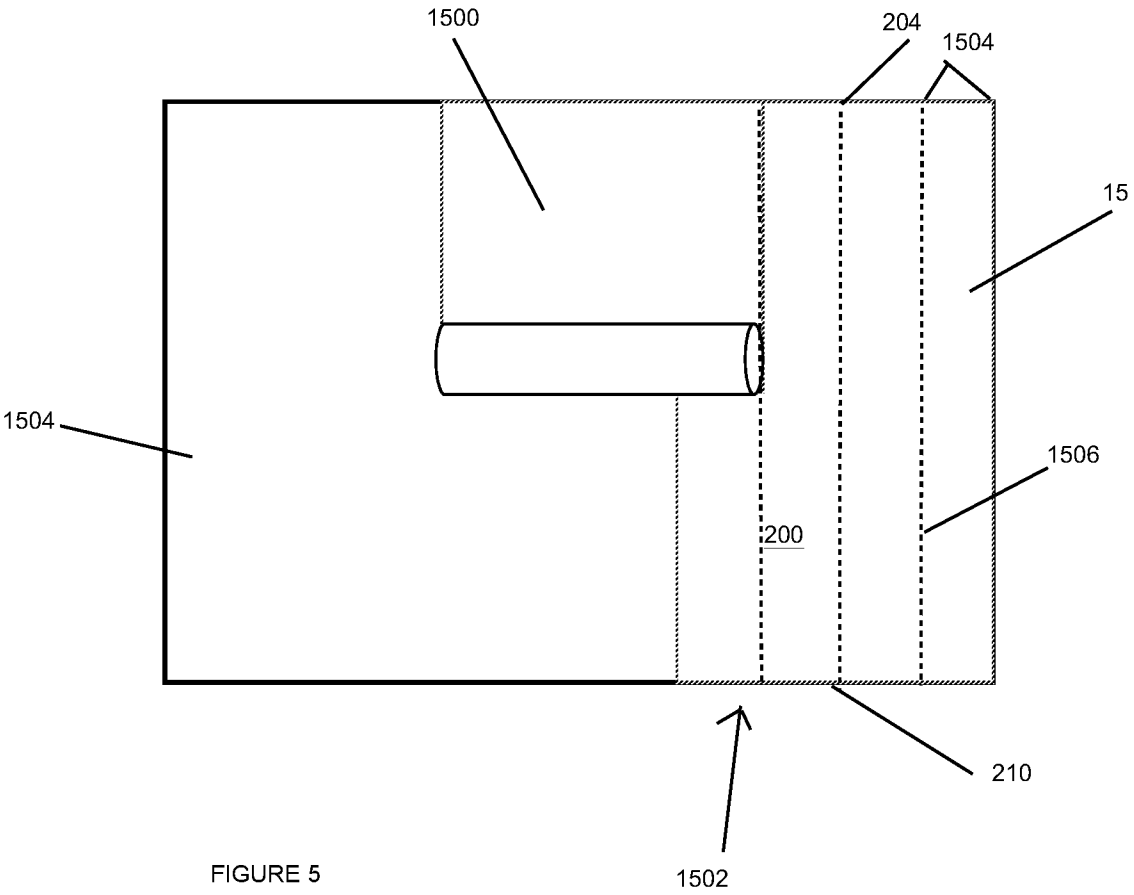
FIG. 5 depicts overlapping underlayment layers.

As shown in FIG. 5, the at least one underlayment layer may be positioned overlapping a row that was previously laid down to create as many rows as are needed to entirely cover the roof deck. The bottom (202) has an adhesive layer applied to it. A second row (1500) of the underlayment roll is positioned overlapping the first row (1502) and dispensed in a second row and cut at the end of the roof deck creating another cut end and fastened at the cut end. The underlayment roll may have on center fastener location markings (1506) of a predetermined length (1504). The underlayment roll is positioned overlapping a row that was previously laid down to create as many rows as are needed to entirely cover the roof deck. The at least one underlayment roll may be rolled onto a center tube for attachment to a dispensing handle. The adhesive and nail rows may be placed horizontal and perpendicular to the vertical metal roofing panels. The moisture barrier adhesive attached underlayment may also be applied horizontal and perpendicular to the vertical metal roofing panels.

The system eliminates all field exposed metal roofing screws, dramatically cuts metal roofing installation time and expensive labor, eliminates the need to measure for accurate screw fastener placement, joins the metal roofing panel system material within 10 minutes, reduces corrosive staining screw shavings to sweep off, reduces the effects of cross panel tensioning (oil canning) and allows metal roofing to lay flat without screw fastener dimpling.

It should be understood that the foregoing relates to preferred embodiments of the invention and that modifications may be made without departing from the spirit and scope of the invention as set forth in the following claims.

I claim:

1. A roofing system, comprising:

at least one underlayment layer;

at least two nail fasteners attached to the at least one underlayment layer and into a roof deck, wherein the roof deck is a steep pitch roof deck having a pitch greater than 2 inches of rise to each 12 inches of run and wherein the head of each of the nail fasteners is above and in communication with the at least one underlayment layer and the shaft is driven through the least one underlayment layer and into the roof deck;

at least one bead of adhesive applied above the underlayment layer in line with the at least two nail fasteners; and at least one metal roofing panel placed on the at least one bead of adhesive applied above the underlayment layer, wherein the at least one metal roofing panel is above the at least two nail fasteners and the at least two nail fasteners do not penetrate the at least one metal roofing panel.

2. A roofing system as in claim 1, wherein the at least two nail fasteners are according to a nail pattern that is sets of three offset rows that are perpendicular to a side of the roofing surface and applied a predetermined distance on center through the underlayment layer.

3. A roofing system as in claim 2, wherein the predetermined distance is six inches on center.

4. A roofing system as in claim 2, wherein the nail pattern is repeated a predetermined length on center.

5. A roofing system as in claim 4, wherein the nail pattern is repeated a predetermined length of 24 inches on center.

6. A roofing system as in claim 1, wherein the at least one underlayment layer is a self-sealing underlayment layer.

7. A roofing system as in claim 1, wherein the at least one underlayment layer has on center fastener location markings according to a nail pattern.

8. A roofing system as in claim 1, wherein the at least one underlayment layer is positioned overlapping a row that was previously laid down to create as many rows as are needed to entirely cover the roof deck.

9. A roofing system as in claim 1, wherein the underlayment layer is a roll applied underlayment layer.

10. A roofing system as in claim 1, wherein the nail fasteners are ring shank roofing nails.

11. A roofing system as in claim 1, wherein the at least two nail fasteners are fastened into a wood support of the roof deck.

12. A roofing system as in claim 1, wherein the at least two fasteners are in withdrawal and also in shear.

13. A roofing system as in claim 1, wherein the at least one underlayment layer is an underlayment roll rolled onto a center tube for attachment to a dispensing handle.

14. A roofing system as in claim 1, wherein the adhesive is a two-part epoxy.

15. A roofing system as in claim 1, wherein the underlayment layer is an adhesive underlayment layer.

16. A roofing system as in claim 15, wherein the adhesive underlayment layer is heat assisted.

17. A roofing system as in claim 1, further comprising an asphalt impregnated felt paper under the at least one underlayment layer and above the roof deck.

* * * * *